United States Patent [19]

Behrens et al.

[11] Patent Number: 4,480,759

[45] Date of Patent: Nov. 6, 1984

[54] CHILD-PROOF CLOSURE

[75] Inventors: Rainer Behrens, Hamburg; Dieter Peissl, Norderstedt Bei Hamburg; Jürgen Schondelmayer, Kempten; Ulrich Brach, Zell-Mosel, all of Fed. Rep. of Germany

[73] Assignee: Lever Brothers Company, New York, N.Y.

[21] Appl. No.: 405,011

[22] Filed: Aug. 4, 1982

[30] Foreign Application Priority Data

Aug. 4, 1981 [DE] Fed. Rep. of Germany ... 8122918[U]

[51] Int. Cl.[3] ..... B65D 55/02

[52] U.S. Cl. ..... 215/220; 215/260; 215/311

[58] Field of Search ..... 215/307, 310, 311, 260, 215/219, 220; 220/366, 367

[56] References Cited

U.S. PATENT DOCUMENTS

| | | | |
|---|---|---|---|
| 2,946,471 | 7/1960 | Randlett | 215/311 |
| 2,953,272 | 9/1960 | Mumford et al. | 215/260 |
| 3,114,467 | 12/1963 | Montgomery | 215/260 |
| 3,147,876 | 9/1964 | Lepore | 215/56 |
| 3,189,234 | 6/1965 | Thomson | 222/542 |
| 3,878,961 | 4/1975 | Curry et al. | 215/219 |

FOREIGN PATENT DOCUMENTS

| | | |
|---|---|---|
| 2550538 | 5/1977 | Fed. Rep. of Germany . |
| 1084564 | 9/1967 | United Kingdom . |

*Primary Examiner*—George T. Hall

[57] ABSTRACT

Child-proof turn-lock closure of plastic material for threaded mouths on containers, particularly on bottles, with a screw cap closure on which an outside cap is clamped with axial play, both of which caps are provided with projections or projections and grooves which, within the axial play, can engage in each other, those sides of the projections or grooves which touch each other when the cap is screwed down being made as carriers, while those sides of the projections or grooves which touch each other when the cap is screwed off act as wedges, and in such a way that, when being screwed down, the screw cap is carried by the outside cap but when being screwed off this only happens when an axial pressure is exerted on the outside cap and directed against the container, wherein recesses are provided in the face of the screw cap, which are covered by a gas- and liquid-impermeable inlay cover. The closure is particularly suitable for bottles containing hypochlorite.

3 Claims, 4 Drawing Figures

CHILD-PROOF CLOSURE

The present invention relates to a child-proof turn-lock closure for threaded mouths on containers, particularly bottles.

Packages are now required for household chemicals which prevent small chldren from getting hold of them. This is achieved by providing the containers with a child-proof closure. An example of such a child-proof closure is the so-called "Turn-Lock" closure, which has been described in German patent specification No. 2,550,538. This closure, which works according to the turn-lock principle, consists of a screw cap closure over which an outside cap is clamped with axial play. On the caps, projections or projections and grooves are provided which, within the axial play, can engage in each other. Those sides of the projections or grooves which touch each other when the cap is screwed down are made as carriers, while those sides of the projections or grooves which touch each other when the cap is screwed off work as wedges. When being screwed down, the screw cap is carried by the outside cap, but when being screwed off this only happens when an axial pressure is exerted on the outside cap and directed against the container.

For the packaging of substances which can generate gas during storage, such as e.g. sanitary cleaners containing hypochlorite, it is necessary, however, that air or gas can escape during storage and that spilling of the product during the turn-lock procedure is prevented.

This is now achieved according to the invention by providing the face of the screw cap with recesses, which are covered by a gas- and liquid-impermeable inlay cover. Already at a low over-pressure in the container, this cover is pressed back into the recesses, as with a diaphragm valve, and as a result openings are made between the inlay cover and the edge of the container opening, through which the gas can escape from the container and come outside via the screw thread.

The gas- and liquid-impermeable inlay cover can be made of any kind of suitable material, that must, of course, be resistant to attack by the packaged product. For example, a foamed polyethylene disc, fitted closely against the face of the screw cap, is suitable for this.

When the rim of the opening of the container is provided with a lip, such as e.g. a pouring lip or particularly a sealing lip, the inner wall of the screw cap is preferably provided with small ventilating recesses which connect the recesses in the face of the screw cap with the outside air. The gas can then escape from the openings formed at the latter recesses by the over-pressure between the inlay cover and the edge of the container via the ventilating recesses. These small ventilating recesses can be made in any desired direction or have any desired shape. So that spilling of the product will be prevented, the ventilating recesses are preferably made as small, axial ventilating channels in a box-like shoulder made on the inside wall of the screw cap.

The present invention will now be further explained with reference to the drawings.

The outside cap is not shown: the combination of outside cap/screw cap is arranged according to German patent specification No. 2,550,538. The screw cap (1), which is made e.g. of polypropylene, has recesses (2) in its face. On the inner wall of the screw cap there is a box-like shoulder (3) in which axial, small ventilating channels (4) are provided. This shoulder extends in axial direction only over a part of the inner wall of the screw cap.

Figure 1:
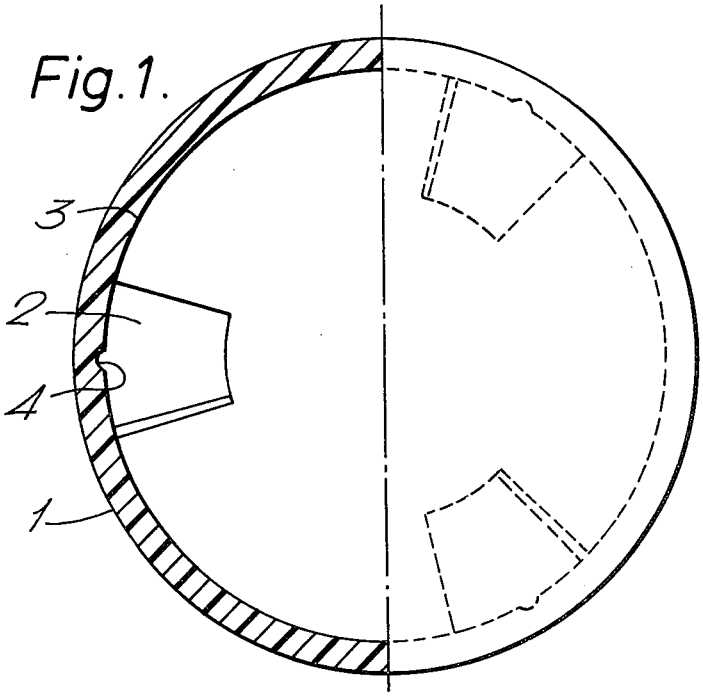
FIG. 1 shows a bottom view of the screw cap without inlay cover.
Figure 2:
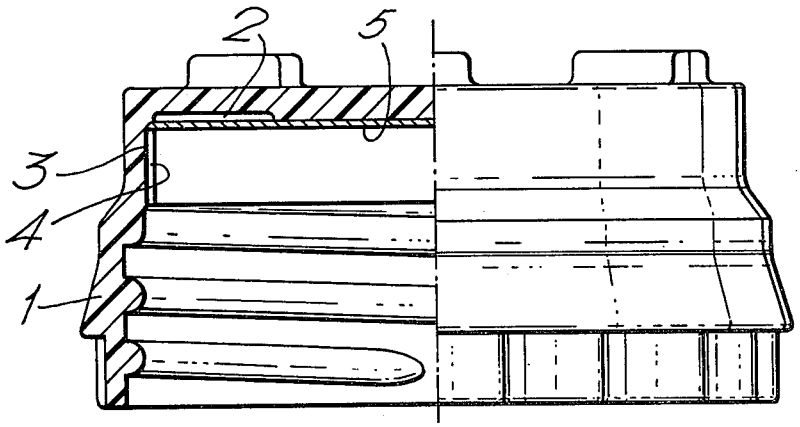
FIG. 2 shows a cross-section through the screw cap with inlay cover.
Figure 3:
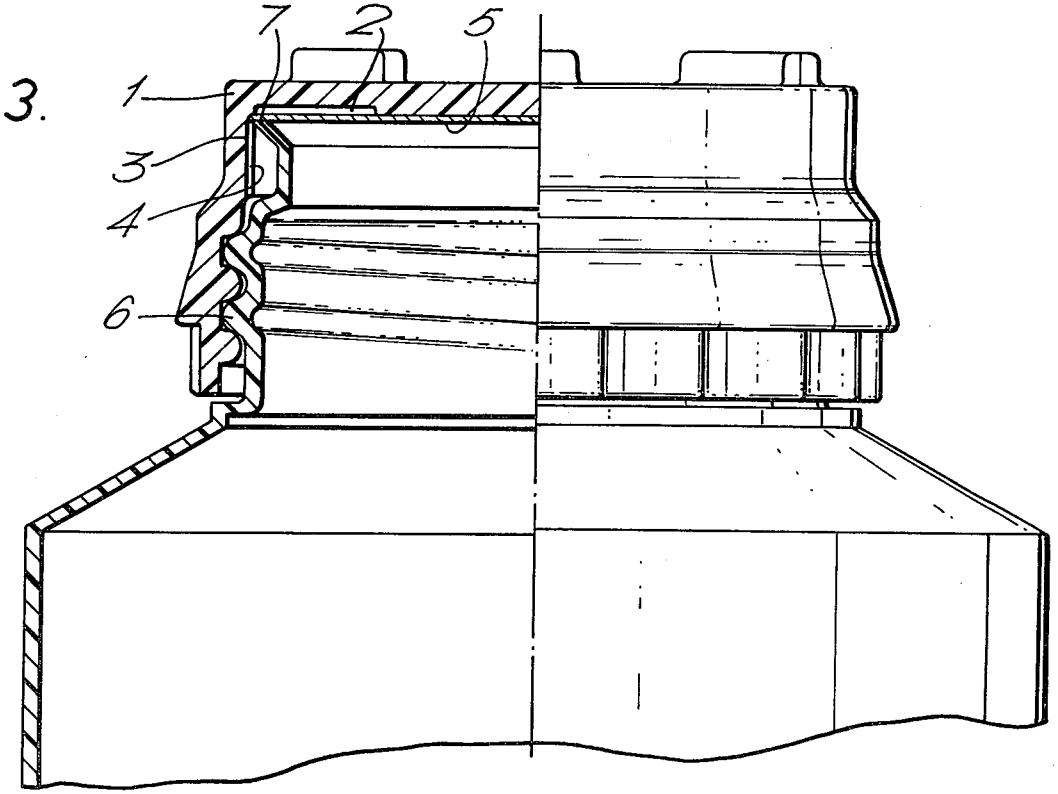
FIG. 3 shows a cross-section through a screw cap with inlay cover screwed on to the neck of a bottle having a sealing lip.

In FIG. 2 the recesses (2) are covered by a foamed polyethylene sealing disc (5), and in FIG. 3 the neck (6) of the bottle is provided with a sealing lip (7) on the rim.

If an over-pressure now forms in the bottle, the sealing disc (5) is then pressed back into the recesses (2), as a result of which openings form between the edge of the neck of the bottle and the sealing disc. The gas can then escape through these openings and by means of the ventilating channels (4).

The caps can be made of any suitable material: e.g. the outside cap can be made of polyethylene and the screw cap of polypropylene.

The closure according to the invention is particularly suitable for bottles in which liquid cleaning compositions containing hypochlorite are packaged.

We claim:

1. Child-proof turn-lock closure of plastic material for threaded mouths on containers, particularly on bottles, with a screw cap closure on which an outside cap is clamped with axial play, both of which caps are provided with projections or projections and grooves which, within the axial play, can engage in each other, those sides of the projections or grooves which touch each other when the cap is screwed down being made as carriers, while those sides of the projections or grooves which touch each other when the cap is screwed off act as wedges, and in such a way that, when being screwed down, the screw cap is carried by the outside cap but when being screwed off this only happens when an axial pressure is exerted on the outside cap and directed against the container, characterized in that recesses (2) are provided in the face of the screw cap, which are covered by a gas- and liquid-impermeable inlay cover (5).

2. Closure according to claim 1, characterized in that the inner wall of the screw cap is provided with small ventilating recesses (4).

3. Closure according to claim 2, characterized in that the small ventilating recesses (4) are made as small, axial channels in a box-like choulder (3) made on the inside wall of the screw cap.

* * * * *

UNITED STATES PATENT AND TRADEMARK OFFICE

CERTIFICATE OF CORRECTION

PATENT NO. : 4,480,759

DATED : November 6, 1984

INVENTOR(S) : Behrens, et al.

It is certified that error appears in the above—identified patent and that said Letters Patent is hereby corrected as shown below:

Column 2, line 12, delete the phrase:

"outside cap is not shown: the"

Figure 4:
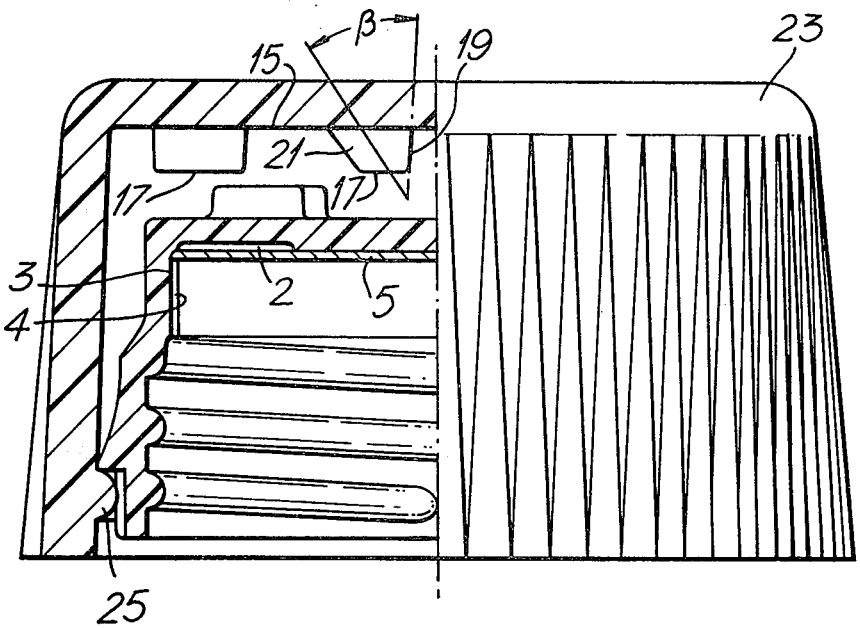
FIG. 4 is a view similar to FIG. 2, but illustrating an outside cap over the inner cap.

Column 2, line 35, after the period (.) add the sentence:

--An outside cap 23 is illustrated in Figure 4 for closing the system.--

Signed and Sealed this

*Second* Day of *July 1985*

[SEAL]

*Attest:*

DONALD J. QUIGG

*Attesting Officer* *Acting Commissioner of Patents and Trademarks*